US007821879B2

(12) United States Patent
Buttet et al.

(10) Patent No.: US 7,821,879 B2
(45) Date of Patent: Oct. 26, 2010

(54) MECHANISM FOR DISPLAYING PICTURES, FIGURES OR SIGNS PRODUCED ON A TIMEPIECE DIAL

(75) Inventors: Mathias Buttet, Divonne les Bains (FR); Enrico Barbasini, Ambilly (FR); Michel Navas, Collonges (FR)

(73) Assignee: BNB Concept SA (CH)

( * ) Notice: Subject to any disclaimer, the term of this patent is extended or adjusted under 35 U.S.C. 154(b) by 315 days.

(21) Appl. No.: 11/574,379

(22) PCT Filed: Aug. 30, 2004

(86) PCT No.: PCT/EP2004/009638

§ 371 (c)(1),
(2), (4) Date: Nov. 14, 2007

(87) PCT Pub. No.: WO2006/024310

PCT Pub. Date: Mar. 9, 2006

(65) Prior Publication Data

US 2008/0068931 A1 Mar. 20, 2008

(51) Int. Cl.
*G04B 19/00* (2006.01)
*G04B 19/20* (2006.01)
*G04B 19/02* (2006.01)

(52) U.S. Cl. ..... 368/223; 368/77; 368/220; 368/233

(58) Field of Classification Search ..... 368/220, 368/223, 233, 77, 37
See application file for complete search history.

(56) References Cited

U.S. PATENT DOCUMENTS

| | | | | |
|---|---|---|---|---|
| 359,227 | A * | 3/1887 | Pallweber | 368/221 |
| 5,359,578 | A * | 10/1994 | Truini | 368/76 |
| 6,507,536 | B1 * | 1/2003 | Keatch | 368/16 |
| 6,754,139 | B2 * | 6/2004 | Herbstman et al. | 368/77 |
| 7,061,833 | B2 * | 6/2006 | Dierenbach | 368/76 |
| 7,075,860 | B2 * | 7/2006 | Dias | 368/77 |
| 2003/0099159 | A1 * | 5/2003 | Herbstman et al. | 368/77 |
| 2005/0276168 | A1 * | 12/2005 | Conus et al. | 368/220 |

FOREIGN PATENT DOCUMENTS

| | | | |
|---|---|---|---|
| DE | 93 19 908 | U1 | 2/1994 |
| DE | 94 05 308 | U1 | 8/1994 |
| FR | 2 767 930 | A | 3/1999 |
| JP | 07 244173 | A | 9/1995 |

* cited by examiner

*Primary Examiner*—Edwin A. Leon
*Assistant Examiner*—Vanessa Girardi
(74) *Attorney, Agent, or Firm*—Ostrolenk Faber LLP

(57) ABSTRACT

The inventive mechanism comprises a series of toothed wheels meshing each with other or by groups and driven by a mobile which is connected to a basic timepiece movement by means of a mobile, wherein each toothed wheel is superimposed by a disc carrying pictures, figures or signs and rotating in a corresponding bore of the timepiece dial.

11 Claims, 3 Drawing Sheets

MECHANISM FOR DISPLAYING PICTURES, FIGURES OR SIGNS PRODUCED ON A TIMEPIECE DIAL

CROSS REFERENCE TO RELATED APPLICATIONS

The present application is a 35 U.S.C. §§371 national phase conversion of PCT/EP2004/009638, filed Aug. 30, 2004. The International Application was published in the French language.

BACKGROUND OF THE INVENTION

The object of the invention is a mechanism for display of animated drawings, figures or signs on a timepiece dial.

For a number of years, "novelty" models (of a "fun" or psychedelic nature) have existed on the watch market, including certain Swatches or Silberstein watches or the Opus III by Harry Winston.

All of these timepieces present the particularity of being original and in line with a fashion mood, but in general their major fault is difficulty in reading the time.

SUMMARY OF THE INVENTION

The display mechanism according to the invention can equip a manual winding, automatic, quartz or autoquartz basic movement and presents the particularity of animating the dial of the watch by reconstituting a given pattern for a chosen period (from one minute to 24 hours).

The display mechanism for display of animated drawings, figures or signs on a timepiece dial is characterized in that it comprises at least one toothed wheel placed under an opening of a dial of a timepiece and driven by means of a mobile which is itself linked with the basic movement of the timepiece, a small plate being mounted on the toothed wheel and carrying a drawing, a figure or a sign designed to be animated in relation to the dial.

The display mechanism comprises several toothed wheels linked with each other or controlled separately or in groups.

The display mechanism may comprise a first series of twelve toothed wheels placed on the outer part of the mechanism and second series of six toothed wheels placed between the center of the dial and the first series of twelve toothed wheels.

The small plates mounted on the toothed wheels are preferably disks (2 and 4, see FIG. 1) designed to rotate in a corresponding opening of the dial. The disks may be positioned at the same level as the dial or positioned to stand out with respect to the level of the dial or inlaid under the dial.

The mechanism may be constructed to animate at least one or several groups of disks. The disks are generally used to animate a design or an image. They may however, in a variant, animate the hour, the minute, the month, the days of the week, the seasons, the equinoxes, the solstices, day and night, etc.

The drawings represent, as an example, a mode of execution of a mechanism for display of animated drawings, figures or signs on a timepiece dial, the object of the invention.

DESCRIPTION OF A PREFERRED EMBODIMENT

Figure 1:
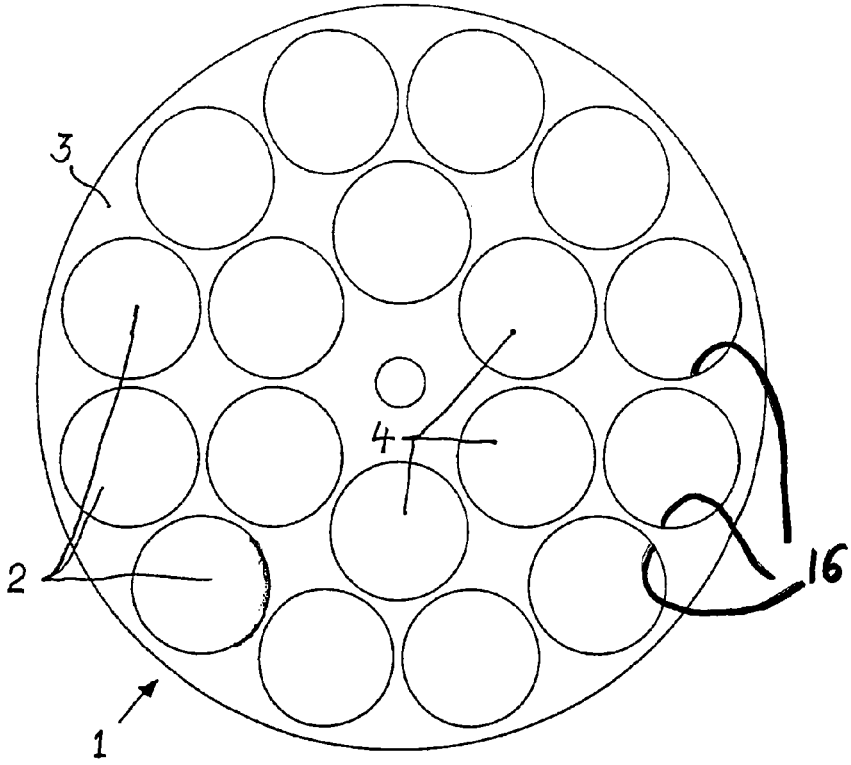
FIG. 1 is a schematic top view of the mechanism.

The display mechanism shown in the drawings is presented in the form of an additional module which can equip timepieces, notably a manual winding basic movement, an automatic movement or a quartz or autoquartz movement. It presents the particularity of animating the dial of the timepiece by reconstituting a given pattern or drawing for a period chosen beforehand, for example one minute, one hour or 12 or 24 hours.

FIG. 1 explains the layout of moving parts of the dial. This layout is not exhaustive and may be modified at will.

The display mechanism (1) comprises twelve disks (2) distributed uniformly on the minute track of a dial (3) and placed midway between the positions of the hour pointers. Alternatively, the position of the disks (2) could coincide with the point at which the pointers indicating the hours are usually located.

An additional series of six disks (4) of the same diameter as the disks (2) are distributed concentrically around the dial (3) and positioned at an angular half-pitch value with respect to the first series of twelve disks (2). All of the disks (2 and 4) will be driven by the driving mechanism represented in FIG. 4 and described below and the disks (2 and 4) will be placed in corresponding openings (16) in the dial (3), so that they are in the same plane as the dial (3).

Figure 2:
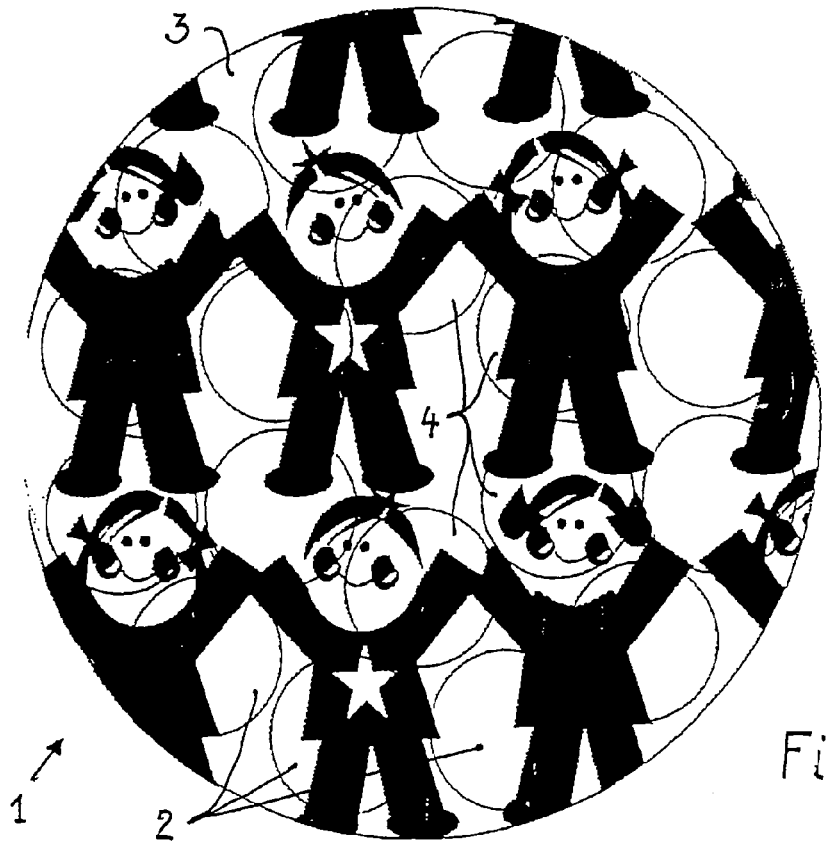
FIG. 2 is a top view of the mechanism, the dial of the mechanism having been equipped with figures to be animated.
Figure 3:
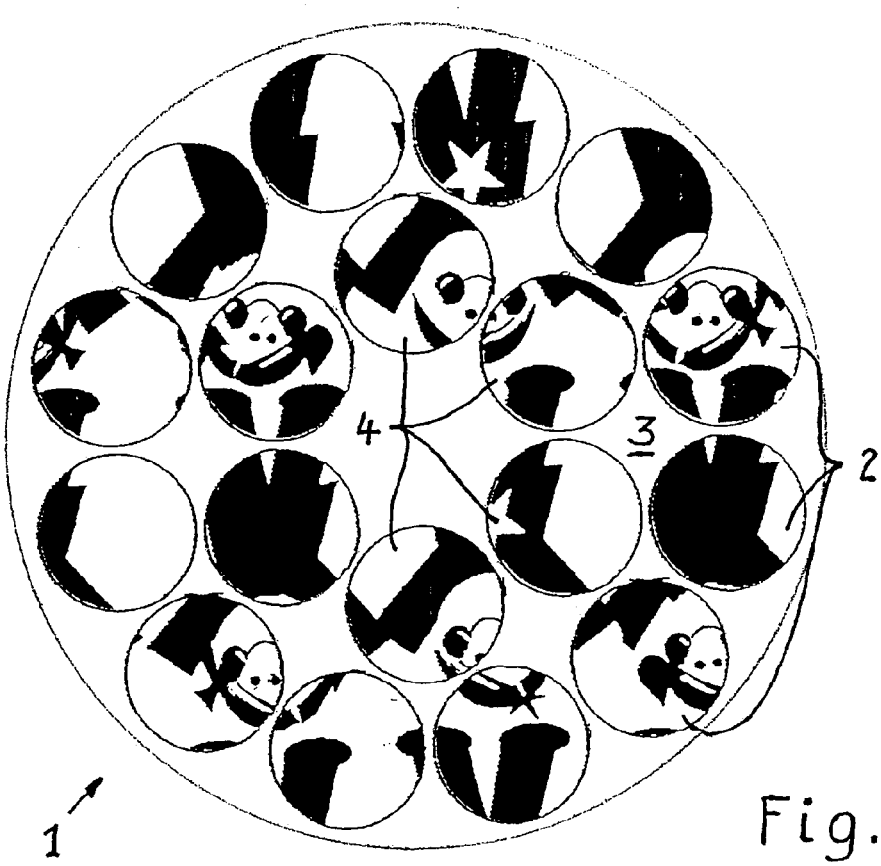
FIG. 3 is view similar to that in FIG. 1, the mechanism having been placed in animation.

When the driving mechanism drives the disks (2 and 4), the uncut part of the dial (3) retains the decoration in a fixed way; the eighteen disks, for their part, may be animated in rotation at a speed chosen between less than a minute and more than a day (FIGS. 2 and 3). The image represented in FIG. 2 is thus broken up and it is reconstituted after a certain period of time to return to the drawing in FIG. 2.

In the case cited above, the disks (2 and 4) are trailing, that is to say they move in a continual fashion, forming the drawing on the dial progressively without ever really stopping on the image. The mechanism (1) can however be constructed to pause on the reconstituted image. In addition, a disk or a series of disks (2 and 4) can be driven independently from the others, so as to obtain special visual effects during the partial or complete reconstitution of the image.

Figure 4:
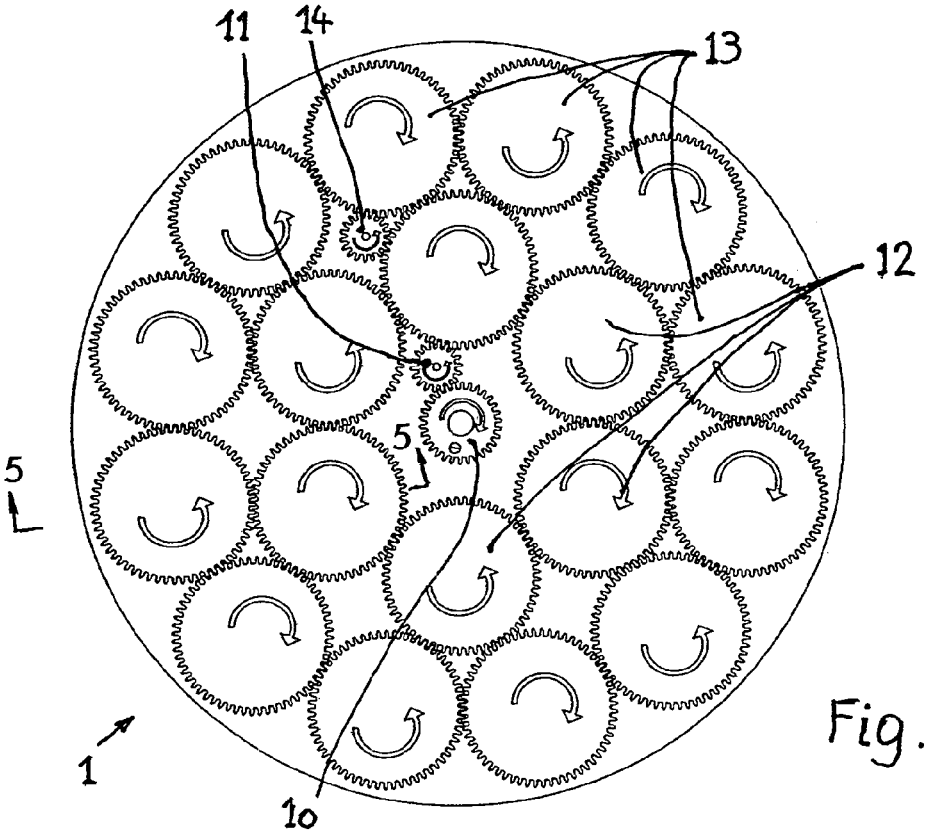
FIG. 4 is a top view of the drive device of a mechanism as shown in FIGS. 1 to 3.

The driving mechanism driving the disks (2 and 4) is represented in FIG. 4 and functions as follows: The wheel (10) is attached to a mobile which is part of the basic movement of the timepiece which is fitted with the display mechanism (1), for example the hour wheel of a basic caliber or its minute wheel work, or any other mobile.

The wheel (10) rotates in the clockwise direction and meshes directly with a pinion (11) which rotates in the anticlockwise direction. The latter drives a wheel (12) in the clockwise direction. The wheel (12) is identical to the other seventeen wheels (12 and 13) included in the display mechanism (eighteen including it). These eighteen wheels successively represent the six inner wheels (12) and the twelve outer wheels (13). Each of these wheels carries a disk (2, 4). These disks are visible on the dial side and give by their movement the desired animation on the dial side. As can be seen in the drawings, these wheels (12, 13) have the same diameter. The wheel (12) rotating in the clockwise direction is positioned at the same height level as the other five wheels (12) in its group, causing the mobiles to rotate alternately in the clockwise and anti-clockwise direction. The number of wheels in the group being even, this enables the last wheel to mesh with the first wheel without blocking it as it is rotating in the opposite direction. These six wheels can therefore be driven by any one of these six wheels. In other words, the pinion (11) may be located angularly all around the wheel (10) in such a way as to mesh with one of the six wheels (12).

The twelve outer wheels (13) of the same diameter as the six inner wheels (12) are positioned at a different height so that the teeth of these twelve outer wheels (13) do not touch the lower six inner wheels (12). The mobile (14) acting on the two different heights of the group of six wheels and the group of twelve wheels receives its speed of rotation from the group of six wheels and redistributes it to the group of twelve wheels. This mobile (14) may be positioned at any point provided that its pitch diameter is tangent to a wheel in the inner group and tangent to a wheel in the outer group. The number of wheels in the group of twelve being even, the direction of rotation of the mobile is alternately clockwise and anti-clockwise.

Figure 5:
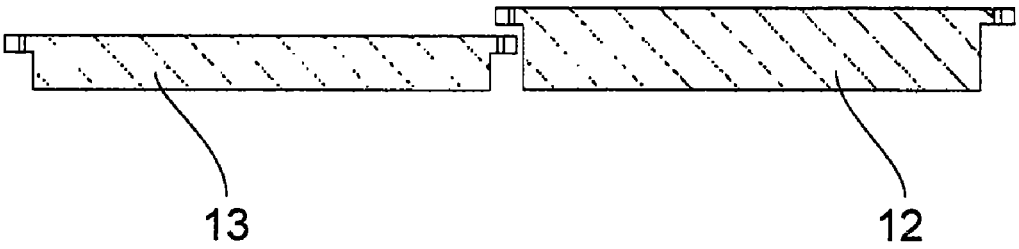
FIG. 5 is a cross section along the line 5-5 in FIG. 4.

FIG. 5 shows the two levels of meshing of the group of six wheels and the group of twelve wheels. It represents a cross section between an inner wheel (12) and an adjacent outer wheel (13). We notice in the cross section in FIG. 5 the two level heights between the inner wheels (12) and the outer wheels (13). On these wheels (12 and 13) are placed disks, such as those shown in FIGS. 1 to 3.

The driving mechanism driving the disks (2 and 4) may comprise an impulse device (not shown) constructed to move the disks (2 and/or 4) in jerks of 30° for example on each jump. It would thus be possible to indicate the time using the twelve disks (13); the design or image placed on the disks (13) would then be the succession of numbers representing the twelve hours and the image would thus be broken up with the exception of a single disk indicating the time. The movement (successive recomposing of the numbers) is timed by the impulses received by the wheel (10) of the driving mechanism driving the disks (2 and 4) when it is assembled on the impulse device. The impulse device inevitably contains an hour wheel which jumps, as its name suggests, from hour to hour, making jumps of 30°.

The advantage of this arrangement is that it is possible to indicate the time without an hour hand if desired, the number representing the current hour being recomposed in one go and remaining displayed for a full hour.

The hour hand can be replaced by a transparent disk (sapphire disk) comprising a translucent area of a different color so as to indicate the place at which the recomposed number must be read, thus facilitating quick reading of the time.

The display mechanism and driving mechanism which have just been described based on FIGS. 1 to 5 of the drawings offer the following possibilities:

The disks (2 and 4) are or are not positioned at the same level as the level (0) of the dial (they may stand out or be inlaid).

The design or the decorations of these disks may or may not represent a coherent design.

The mechanism is constructed to perform the action of disassembling and reconstituting a single design, sign or logo or several designs, signs and logos on the same dial.

The mechanism may control the twelve outer disks (2) in one of the ways cited above, but rotate the six inner disks (4) (or only one of these disks) at a speed different from that of the twelve outer disks (2), so as to indicate for example AM/PM by means of colored disks alternately representing day and night.

According to a preferred mode of execution, the mechanism cited as an example has an external diameter of 30 mm and contains disks visible on the dial side with a diameter of 5.7 mm. The dial has a thickness of 0.4 mm.

Obviously, for the same principle used in a smaller-sized watch, for example a ladies' watch, or a watch of intermediate size, the dimensions of the dial and the disks will be different. Finally, the number of these disks may vary between 1 and 50.

The mechanism may furthermore be used for larger timepieces (ranging from small clocks to floral clocks in squares in large towns).

The invention claimed is:

1. A mechanism for display of animated drawings, figures or signs on a dial of a timepiece having a basic movement, the mechanism comprising at least one series of toothed wheels, each of said toothed wheels in a first series of toothed wheels of said at least one series of toothed wheels being placed under an opening of the dial; wherein said each of said toothed wheels in said first series of toothed wheels meshes with two adjacent toothed wheels of said first series of toothed wheels to form a first continuous closed gear train; wherein said each of said toothed wheels in said first series of toothed wheels carries a plate located in the opening of the dial and bearing a drawing, figure or sign, at least one plate to be animated in relation to the dial; and wherein one of said toothed wheels in said first series of toothed wheels is driven by a first mobile, said first mobile being driven by the basic movement of the timepiece.

2. The mechanism according to claim 1, the mechanism further comprising a second series of toothed wheels of said at least one series of toothed wheels, each of said toothed wheels in said second series of toothed wheels being placed under an opening of the dial; wherein each of said toothed wheels in said second series of toothed wheels meshes with two adjacent toothed wheels in said second series of toothed wheels to form a second continuous closed gear train; wherein each of said toothed wheels in said second series of toothed wheels carries a plate located in the opening of the dial and bearing a drawing, figure or sign, at least one plate to be animated in relation to the dial; and wherein one of said toothed wheels in said second series of toothed wheels meshes with a second mobile, the second mobile also meshing with one of said toothed wheels in said first series of toothed wheels.

3. The mechanism according to claim 2, wherein each of the plates carried by the toothed wheels are disks designed to rotate in a respective opening in the dial.

4. The mechanism according to claim 1, wherein one of said at least one series of toothed wheels comprises twelve toothed wheels located on an outer part of the mechanism.

5. The mechanism according to claim 4, wherein another one of said at least one series of toothed wheels comprises six toothed wheels placed between a center of the dial and said one of said at least one series of toothed wheels.

6. The mechanism according to claim 1, wherein each of the plates carried by the toothed wheels are disks designed to rotate in a respective opening in the dial.

7. The mechanism according to claim 6, wherein the disks are positioned at the same level as the dial.

8. The mechanism according to claim 6, wherein the disks are positioned to stand out with respect to the level of the dial or be inlaid under the dial.

9. The mechanism according to claim 6, wherein the disks are used to display any chosen design, image or sign, or any time period including the hour, the minute, the month, the days of the week, the seasons, the equinoxes, the solstices, and day and night.

10. The mechanism according to claim 6, wherein the disks and the dial are treated galvanically or are prepared by methods including mounting, jewelling, engine-turning, transferring, engraving, and cutting.

11. The mechanism according to claim 6, wherein the mechanism is constructed to drive the disks at constant speed.

* * * * *